US010328729B2

(12) United States Patent
Lim et al.

(10) Patent No.: US 10,328,729 B2
(45) **Date of Patent: *Jun. 25, 2019**

(54) PRINTER WITH TRANSPORT SPEED CONTROLLER

(71) Applicant: TOSHIBA TEC KABUSHIKI KAISHA, Tokyo (JP)

(72) Inventors: Chen Pang Lim, Singapore (SG); Noriyuki Watanabe, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/875,232

(22) Filed: Jan. 19, 2018

(65) Prior Publication Data

US 2018/0222223 A1 Aug. 9, 2018

(30) Foreign Application Priority Data

Feb. 8, 2017 (JP) ..... 2017-021336

(51) Int. Cl.
*B41J 15/04* (2006.01)
*B41J 13/00* (2006.01)
*B41J 2/32* (2006.01)

(52) U.S. Cl.
CPC ..... *B41J 13/0027* (2013.01); *B41J 2/32* (2013.01); *B41J 15/042* (2013.01)

(58) Field of Classification Search
CPC ..... B41J 13/0027; B41J 15/042; B41J 2/32
See application file for complete search history.

(56) References Cited

U.S. PATENT DOCUMENTS 5,400,059 A 3/1995 Kwon
5,871,291 A 2/1999 Kawazoe
8,179,409 B2 * 5/2012 Saga ..... B41J 2/355 347/190

(Continued)

FOREIGN PATENT DOCUMENTS

JP H06-127049 5/1994
JP H07-329388 12/1995

(Continued)

OTHER PUBLICATIONS

Computer-generated translation of JP 06-127049, published on May 1994.*

(Continued)

*Primary Examiner* — Huan H Tran
(74) *Attorney, Agent, or Firm* — Kim & Stewart LLP

(57) ABSTRACT

A printer according to an embodiment includes a communication interface that receives print data from an external device. A print head prints on a sheet, line by line according to the received print data. A motor drives a roller to transport the sheet, line by line according to the received print data. A processor configured determines, for a current print line, a target transport speed for transporting the sheet, and determines one or more intermediate speeds defined in advance and between a current transport speed of transporting the sheet and the target transport speed. The processor controls the motor to transport the sheet at each determined intermediate speed and the target transport speed, sequentially.

20 Claims, 7 Drawing Sheets

(56) References Cited

U.S. PATENT DOCUMENTS

| | | | | |
|---|---|---|---|---|
| 8,670,010 | B2 * | 3/2014 | Kano | B41J 2/355 347/171 |
| 2004/0090517 | A1 | 5/2004 | Nishimura | |
| 2005/0219345 | A1 * | 10/2005 | Muto | B41J 2/355 347/180 |
| 2005/0264593 | A1 * | 12/2005 | Nagamura | B41J 2/0457 347/5 |
| 2018/0222222 | A1 * | 8/2018 | Lim | B41J 2/355 |

FOREIGN PATENT DOCUMENTS

| | | | | |
|---|---|---|---|---|
| JP | 2009-113445 | * | 5/2009 | B41J 2/335 |
| JP | 2013-22925 | | 2/2013 | |

OTHER PUBLICATIONS

Computer-generated translation of JP 2009-113445, published on May 2009.*

Extended European Search Report dated Jun. 18, 2018, filed in counterpart European Patent Application No. 18151164.3 (6 pages).

* cited by examiner

FIG. 3
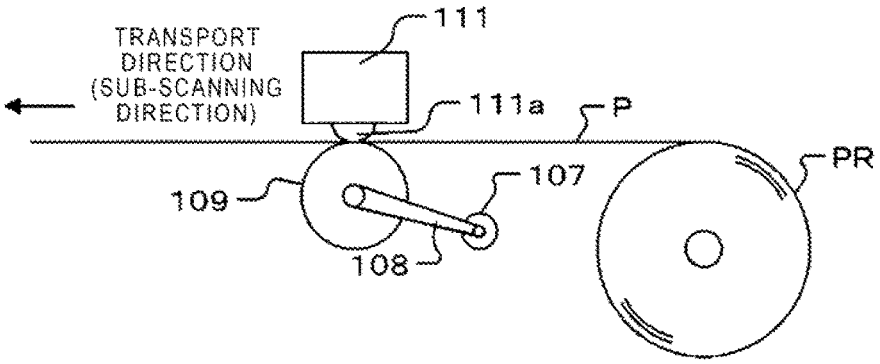
FIG. 4
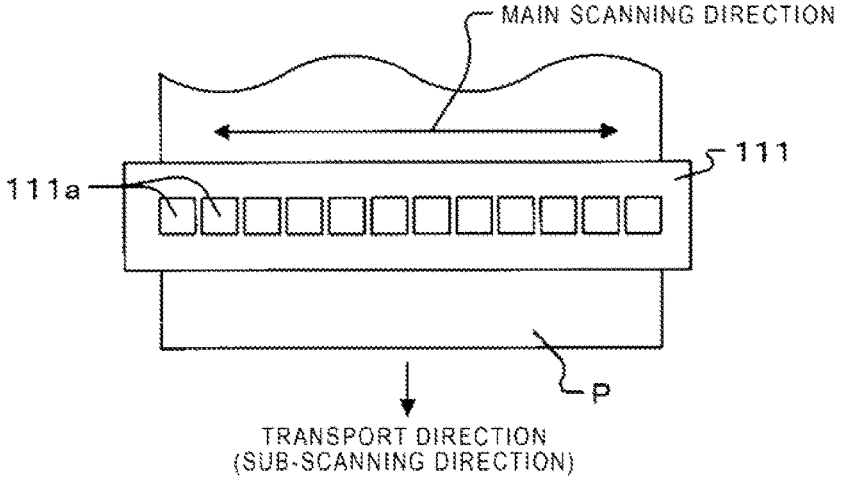
FIG. 5
| No. | PRINT RATE (%) | TRANSPORT SPEED (IPS) |
|---|---|---|
| 1 | $0 \leqq R < Ra$ | 14.0 |
| 2 | $Ra \leqq R < Rb$ | 13.0 |
| ⋮ | ⋮ | ⋮ |
| 7 | $Rf \leqq R < Rg$ | 7.0 |
| ⋮ | ⋮ | ⋮ |
| 14 | $Rm \leqq R \leqq 100$ | 1.0 |
(TRANSPORT SPEED DATA)

| No. | TRANSPORT SPEED (IPS) | TRANSPORT PULSE CONTROL INFORMATION |
|---|---|---|
| 1 | 0≦V<1. 0 | FC1 |
| 2 | 1. 0≦V<2. 0 | FC2 |
| 3 | 2. 0≦V<4. 0 | FC3 |
| 4 | 4. 0≦V<6. 0 | FC4 |
| 5 | 6. 0≦V<8. 0 | FC5 |
| 6 | 8. 0≦V<10. 0 | FC6 |
| 7 | 10. 0≦V≦14. 0 | FC7 |

(TRANSPORT PULSE CONTROL DATA)

FIG. 8

| No. | TRANSPORT SPEED (IPS) | TRANSPORT PULSE CONTROL INFORMATION | | |
|---|---|---|---|---|
| | | TRANSPORT PULSE (PPS) | TRANSPORT DISTANCE | ACCELERATION |
| 1 | $0 \leqq V < 1.0$ | $0 \leqq Pf < Pf1$ | L1 | A1 |
| 2 | $1.0 \leqq V < 2.0$ | $Pf1 \leqq Pf < Pf2$ | L2 | A2 |
| 3 | $2.0 \leqq V < 4.0$ | $Pf2 \leqq Pf < Pf3$ | L3 | A3 |
| 4 | $4.0 \leqq V < 6.0$ | $Pf3 \leqq Pf < Pf4$ | L4 | A4 |
| 5 | $6.0 \leqq V < 8.0$ | $Pf4 \leqq Pf < Pf5$ | L5 | A5 |
| 6 | $8.0 \leqq V < 10.0$ | $Pf5 \leqq Pf < Pf6$ | L6 | A6 |
| 7 | $10.0 \leqq V \leqq 14.0$ | $Pf6 \leqq V \leqq Pf7$ | L7 | A7 |

PRINTER WITH TRANSPORT SPEED CONTROLLER

CROSS-REFERENCE TO RELATED APPLICATION

This application is based upon and claims the benefit of priority from Japanese Patent Application No. 2017-021336, filed Feb. 8, 2017, the entire contents of which are incorporated herein by reference.

FIELD

Embodiments described herein relate generally to a printer with a transport speed controller.

BACKGROUND

In the related art, in a printer used in a point of sales (POS) terminal, both a desired print quality and a desired printing speed are achieved by controlling a transport speed of a recording medium according to a print rate of print data to be printed on the recording medium such as a receipt sheet.

The printer is required to appropriately control the transport speed until a target transport speed is reached. When a plurality of transport speeds and control information for reaching a desired transport speed are provided, as the number of transport speeds increases, the number of pieces of control information also increases. For example, when there are three transport speeds, six pieces of the control information are required.

DESCRIPTION OF THE DRAWINGS

FIG. 3 is a diagram illustrating a relationship of a position of a platen roller and a thermal head.

FIG. 4 is a diagram of the thermal head as viewed from above.

FIG. 5 is a diagram illustrating transport speed data.

FIG. 8 is a diagram illustrating another example relationship between transport speed and the transport pulse control.

DETAILED DESCRIPTION

Figure 1:
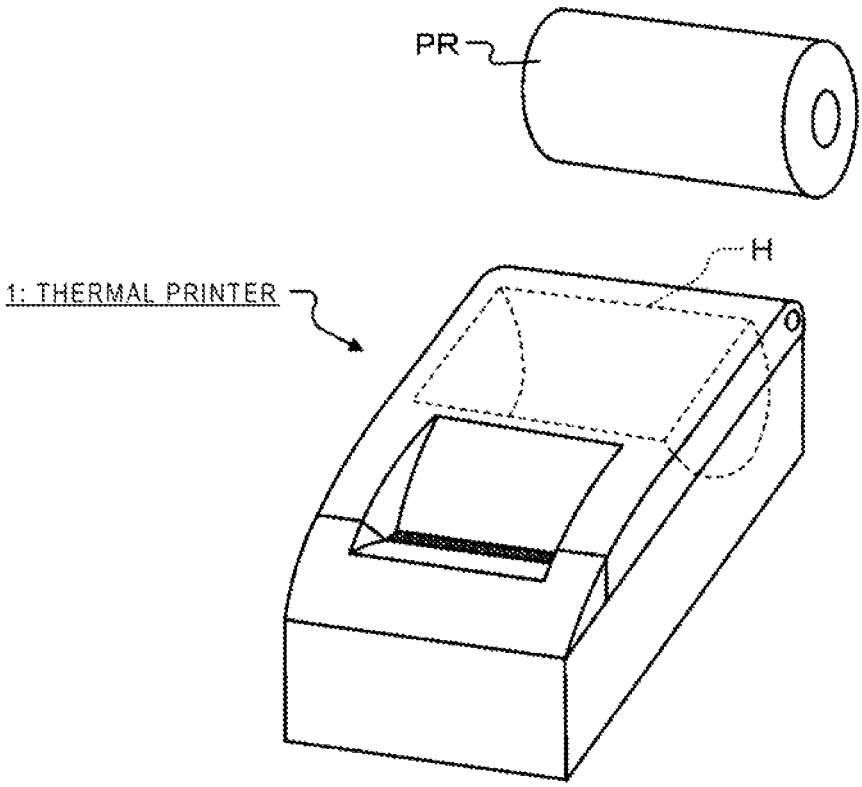
FIG. 1 is a perspective view of a thermal printer that includes a transport speed control apparatus according to an embodiment.

Embodiments provide for a printer with a transport speed controller which can reduce the number of pieces of the control information for reaching the target transport speed by maintaining the number of transport speeds.

A printer according to an embodiment includes a communication interface that receives print data from an external device. A print head prints on a sheet, line by line according to the received print data. A motor drives a roller to transport the sheet, line by line according to the received print data. A processor configured determines, for a current print line, a target transport speed for transporting the sheet, and determines one or more intermediate speeds defined in advance and between a current transport speed of transporting the sheet and the target transport speed. The processor controls the motor to transport the sheet at each determined intermediate speed and the target transport speed, sequentially.

Hereinafter, an embodiment of the present invention will be described with reference to the drawings. A printer with a transport speed controller according to the embodiment is a thermal printer used in a point of sales (POS) terminal. Identical or equivalent parts in the figure are denoted by the same reference numerals.

As illustrated in FIG. 1, a thermal printer 1 includes a holder H that detachably stores and holds a roll paper PR. The roll paper PR is a thermosensitive sheet roll which is colored by heating. A leading edge of the roll paper PR held by the holder H is transported in a direction orthogonal to a rotation axis of the roll paper PR. Information such as transaction details is printed on the transported sheet. The thermal printer 1 includes a controller that controls a transport speed of the sheet according to a print rate of the print data corresponding to the transaction details.

Figure 2:
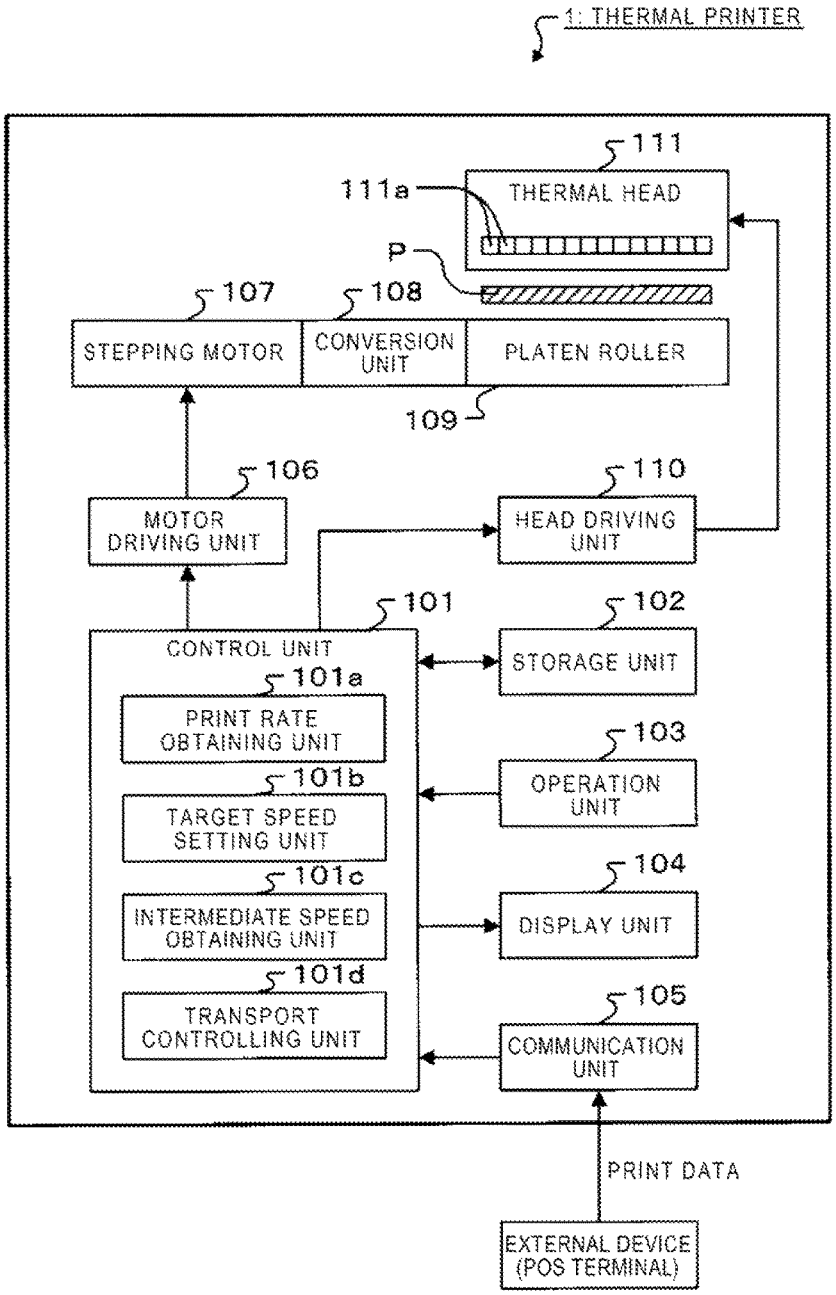
FIG. 2 is a block diagram illustrating an example configuration of the thermal printer.

As illustrated in FIG. 2, the thermal printer 1 includes a control unit 101, a storage unit 102, an operation unit 103, a display unit 104, a communication unit 105, a motor driving unit 106, a stepping motor (pulse motor) 107, a conversion unit 108, a platen roller 109, a head driving unit 110, and a thermal head 111.

The operation unit 103 may be an interface device operated by a user such as a cover opening and closing button for attaching and detaching the roll paper PR, a power source button for switching turn on or off of a power source of the thermal printer 1, a feed button for transporting the sheet P, or a cut button for cutting the sheet.

The display unit 104 includes a display device such as a liquid crystal display and a lighting device such as a light emitting diode (LED) lamp. The display unit 104 displays information indicating various states of the thermal printer 1. For example, the display unit 104 displays a printed state, an opened or closed state of a cover, the amount of paper remaining in the roll paper PR, or the like.

The communication unit 105 is a communication interface that performs communication with an external device such as a point of sales (POS) terminal. The communication unit 105 receives the print data indicating information such as transaction details from the external device through a network. The communication unit 105 supplies the received print data to the control unit 101. The communication unit may communicate with the external device via either wired or wireless communication.

The motor driving unit 106 supplies a transport pulse signal to the stepping motor 107 under the control of the control unit 101, and drives the stepping motor 107.

The stepping motor 107 receives the transport pulse signal from the motor driving unit 106, and rotates by an amount per pulse that is defined in advance, according to the received transport pulse signal.

The conversion unit 108 includes a speed reduction mechanism having a plurality of gears and the like. The conversion unit 108 is provided between the stepping motor 107 and the platen roller 109. The conversion unit 108 transfers rotation force of the stepping motor 107 to the platen roller 109, in order to rotate the platen roller 109.

The platen roller 109 rotates by transferring the rotation force of the stepping motor 107 through the conversion unit 108. In addition, as illustrated in FIG. 3, the platen roller 109 is provided at a position opposed to the thermal head 111.

The sheet P, that is, the leading end of the roll paper PR, is transported in a transport direction (sub-scanning direction) by rotation of the platen roller 109.

The head driving unit 110 supplies a print signal (strobe signal) to the thermal head 111 under the control of the control unit 101, and drives a heat generating element 111*a* provided in the thermal head 111.

The thermal head 111 receives the print signal from the head driving unit 110, and performs printing on the sheet P at a position opposed to the platen roller 109 according to the received print signal.

In addition, as illustrated in FIG. 4, the thermal head 111 includes a plurality of the heat generating elements 111*a* arranged in a direction (main scanning direction) orthogonal to the transport direction. Each of the heat generating elements 111*a* is selectively heated according to the print signal. Each of the heat generating elements 111*a* is divided into a plurality of blocks (element groups), and driven in a time division manner for each line of the print data to be printed.

The storage unit 102 is a storage device such as a hard disk drive (HDD), a read-only memory (ROM), and a flash memory. The storage unit 102 stores a program and data for performing various processes by the control unit 101 and data generated or obtained by performing various processes by the control unit 101.

In addition, as illustrated in FIG. 5, the storage unit 102 stores data (transport speed data) associating a range of a print rate with the transport speed. With this, a target transport speed at which the sheet P is transported is set according to the print rate of the print data.

Figures 6, 7:
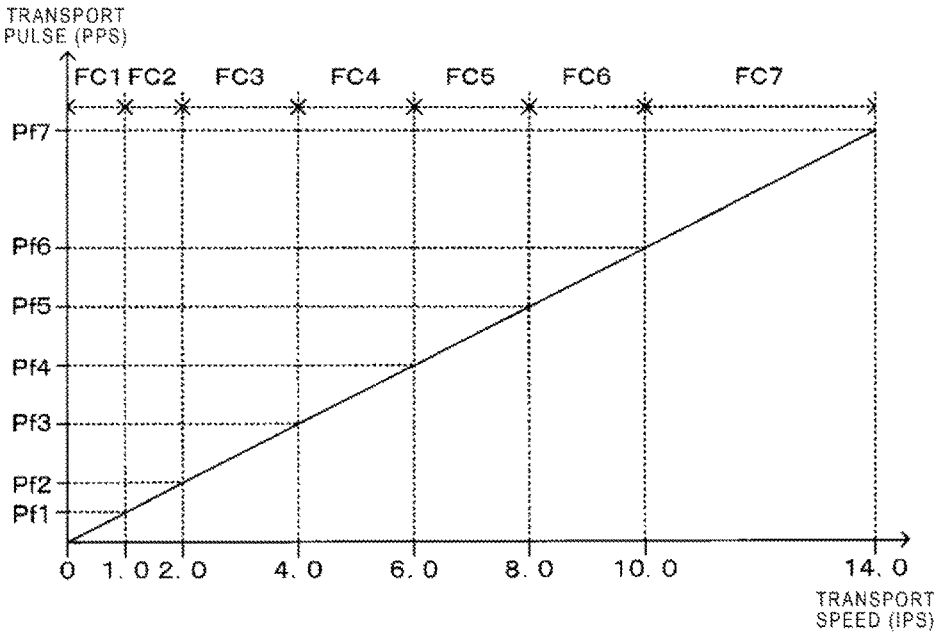
FIG. 6 is a diagram illustrating a transport pulse control data.
FIG. 7 is a diagram illustrating an example relationship between transport speed and transport pulse control.

In addition, as illustrated in FIG. 6, the storage unit 102 stores data (transport pulse control data) obtained by associating a predetermined section of the transport speed with transport pulse control information. The section of the transport speed is divided by at least one or more intermediate speeds between a minimum value and a maximum value of the transport speed. The transport speed data illustrated in FIG. 5 includes 14 transport speeds for each 1.0 inch per second (IPS). In this case, the intermediate speed is set as at least one or more values among 1.0, 2.0, 4.0, 6.0, 8.0, 10.0, and 14.0 (IPS), between the minimum value (0 IPS) and the maximum value (14.0 IPS) of the transport speed. The range of the transport speed is divided into seven ranges.

The transport pulse control information is the control information for changing the current transport speed, and defined for each defined transport speed range. The control unit 101 controls the current transport speed until a target transport speed is reached, based on the transport pulse control information defined for each transport speed range. For example, if the current transport speed is 3.0 IPS, and the target transport speed is 7.0 IPS, the control unit 101 causes the transport speed to sequentially reach the intermediate speed and a target speed such that the current transport speed of the sheet P is controlled to be changed from 3.0 to 4.0 IPS, from 4.0 to 6.0 IPS, and from 6.0 to 7.0 (IPS) based on three pieces of transport pulse control information FC 3, FC 4, and FC 5 set in transport speed range Nos. 3 to 5 in FIG. 7.

As illustrated in FIG. 7, the pulse control information is set to change a pulse frequency (pulses per second, pps) of the stepping motor 107 at a constant rate in a transport speed range that is defined in advance. In this case, the number of defined transport speed ranges may be set according to the print rate, and the amount of change in the pulse frequency per defined transport speed range may be changed.

For example, the number of steps may be obtained by dividing an absolute value of difference between the current transport speed and the target transport speed by the print resolution, that is: |target transport speed−current transport speed|÷resolution=the number of defined transport speed ranges. In this manner, the amount of change in the pulse frequency per defined transport speed range is defined. In FIG. 7, an example in which a change rate of the pulse frequency is the same in all the defined transport speed ranges is illustrated, but the change rate of the pulse frequency may be defined to be different at each defined transport speed range.

In addition, the pulse control information may be set by other methods. For example, as illustrated in FIG. 8, for each transport speed range that is defined in advance, a transport distance L and acceleration A of the sheet P may be set in the pulse control information. In this case, the number of steps according to the print resolution may be set.

For example, the acceleration (A) may be set by an equation of "$Vf^2-V0^2=2\times A\times L$", where Vf=target transport speed, and V0=current transport speed.

Returning to FIG. 2, the control unit 101 includes a central processing unit (CPU), a random access memory (RAM) functioning as the working memory of the CPU, a timer, and the like. A part of the control unit 101 may be configured with a dedicated circuit such as an application specific integrated circuit (ASIC) or a field programmable gate array (FPGA).

In addition, the control unit 101 functions as a print rate obtaining unit 101*a*, a target speed setting unit 101*b*, an intermediate speed obtaining unit 101*c*, and a transport controlling unit 101*d* by executing a program stored in the storage unit 102. That is, in one embodiment, the control unit 101 is a processor that is programmed to carry out the functions of the print rate obtaining unit 101*a*, the target speed setting unit 101*b*, the intermediate speed obtaining unit 101*c*, and the transport controlling unit 101*d*. In another embodiment, the control unit 201 is a hardware controller, e.g., an ASIC or an FPGA, that is configured to carry out the functions of the print rate obtaining unit 101*a*, the target speed setting unit 101*b*, the intermediate speed obtaining unit 101*c*, and the transport controlling unit 101*d*.

Figure 9:
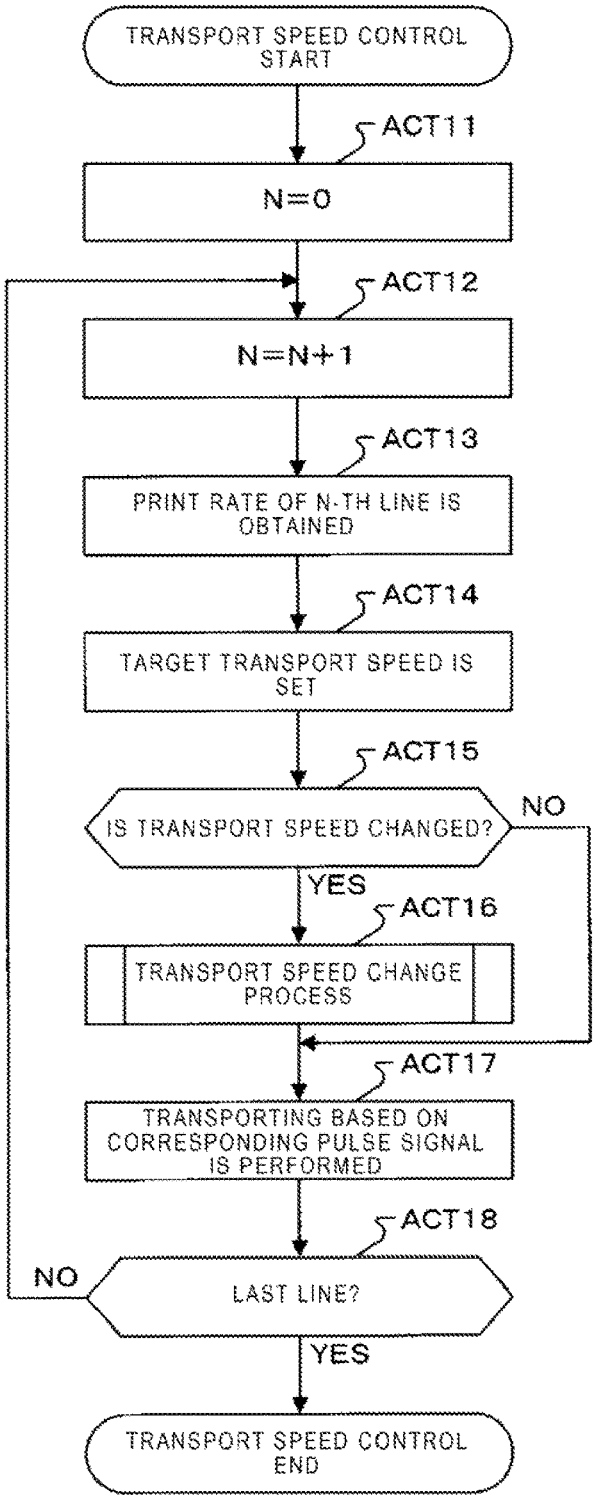
FIG. 9 is a flowchart illustrating a transport speed control process.

A transport speed control process performed by the thermal printer 1 configured as described above will be described below with reference to FIG. 9 and FIG. 10.

The control unit 101 of the thermal printer 1 executes a program stored in the storage unit 102 according to turning on of the thermal printer 1. With this, the control unit 101 functions as the print rate obtaining unit 101*a*, the target speed setting unit 101*b*, the intermediate speed obtaining unit 101*c*, and the transport controlling unit 101*d*.

The print rate obtaining unit 101*a* obtains the print data from the external device such as a POS terminal through the communication unit 105. The print rate obtaining unit 101*a* sets N indicating the current line as "N=0" at a timing at which the print data is obtained (Act 11), and then sets as "N=N+1" (Act 12).

The print rate obtaining unit 101*a* obtains the print rate of the N-th line of the print data (Act 13). The print rate is a rate of the number of print dots with respect to the total number of dots of the dotted line, i.e., a ratio of the number of heat generating elements 111*a* to be used to print the current line and the total number of heat generating elements 111*a*. In an initialization process after obtaining the print data (N=1), the print rate obtaining unit 101*a* obtains the print rate of the first line of the print data.

The target speed setting unit 101*b* refers to the transport speed data illustrated in FIG. 5, and sets the transport speed corresponding to the print rate obtained by the print rate obtaining unit 101*a* as the target transport speed (Act 14). For example, when a print rate R obtained in Act 13 is included in a range of "Rf≤R≤Rg", the transport speed corresponding to the print rate R is set to "7.0 IPS" as the target transport speed.

The target speed setting unit 101*b* determines whether or not the set target transport speed is different from the current transport speed (Act 15). In the initialization process after the print data obtainment (N=1), since the current transport speed is "0 IPS", the target speed setting unit 101*b* determines that the current transport speed needs to be changed (Act 15; YES). In this case, the intermediate speed obtaining unit 101*c* performs a transport speed change process (Act 16).

Figure 10:
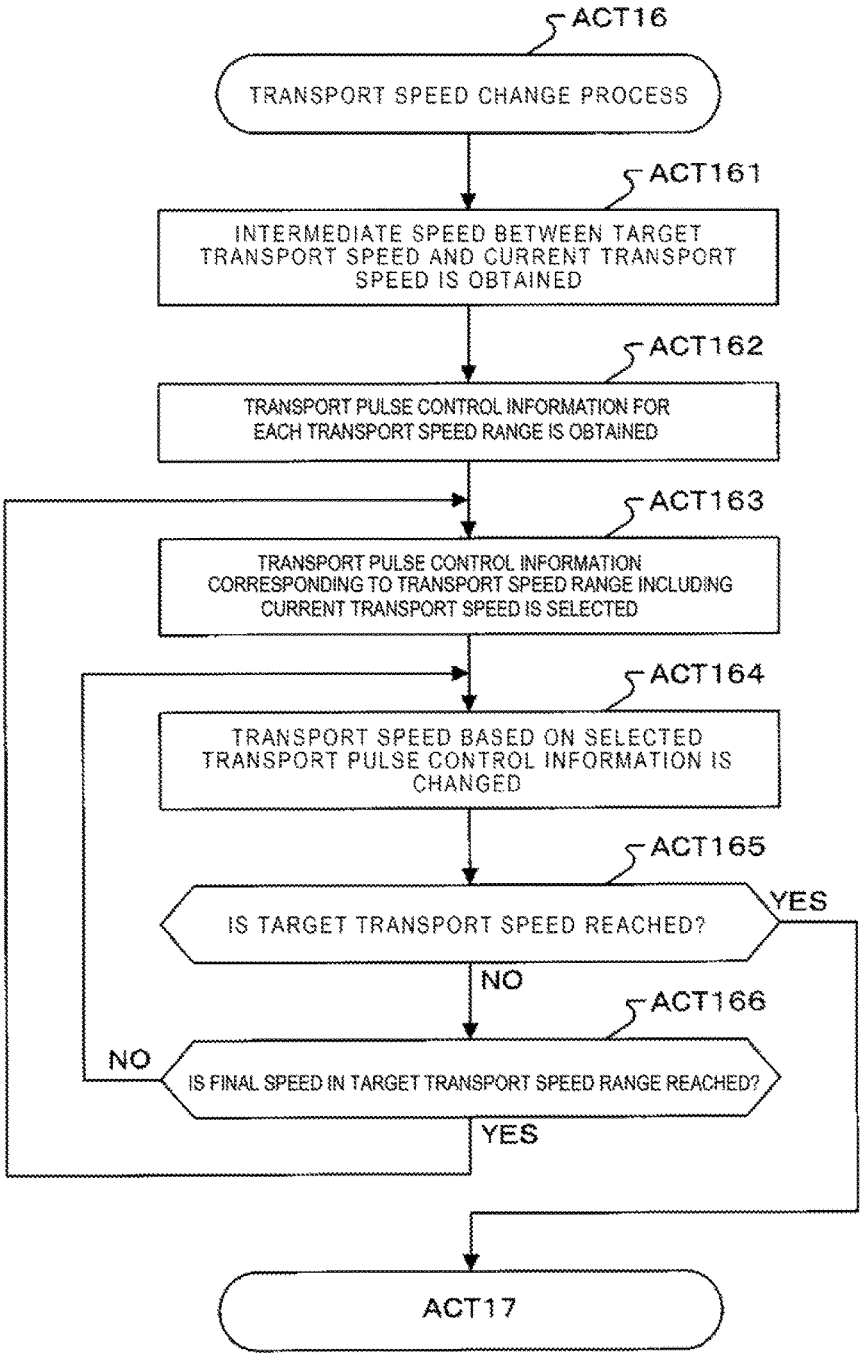
FIG. 10 is a flowchart illustrating a speed change process.

The transport speed change process of Act 16 is illustrated in FIG. 10. As illustrated in FIG. 10, the intermediate speed obtaining unit 101*c* obtains the intermediate speeds that are defined in advance between the target transport speed and the current transport speed set by the target speed setting unit 101*b* (Act 161). In the initialization process after the print data obtainment (N=1), the current transport speed is "0 IPS". In addition, the above-described intermediate speeds are defined as 1.0, 2.0, 4.0, 6.0, 8.0, 10.0, and 14.0 IPS. Therefore, here, the intermediate speed obtaining unit 101*c* obtains the intermediate speeds "1.0 IPS", "2.0 IPS", "4.0 IPS", and "6.0 IPS".

The transport controlling unit 101*d* refers to the transport pulse control data illustrated in FIG. 6, selects each transport speed range corresponding to each intermediate speed obtained by the intermediate speed obtaining unit 101*c*, and obtains the transport pulse control information for each corresponding transport speed range (Act 162). When the current transport speed is set to 0 IPS and the target transport speed is set to 7.0 IPS, the transport controlling unit 101*d* obtains each transport pulse control information from FC1 to FC5 which are set in Nos. 1 to 5.

The transport controlling unit 101*d* selects the transport pulse control information corresponding to the transport speed range including the current transport speed in the transport pulse control information obtained in Act 162 (Act 163). When the current transport speed is 0 IPS, the transport controlling unit 101*d* selects the transport pulse control information FC1 corresponding to No. 1.

The transport controlling unit 101*d* changes the transport speed based on the selected transport pulse control information (Act 164). Here, the transport speed "0 IPS" is changed based on the transport pulse control information FC1.

The transport controlling unit 101*d* determines whether or not the current transport speed reaches the target transport speed or the final speed in a target transport speed range (i.e. the largest or smallest transport speed in the defined range) while performing the change of the transport speed (Act 165 and Act 166). When it is determined that the final speed of the target transport speed range is reached (Act 166; YES), the process of the transport controlling unit 101*d* returns to Act 163. In this case, the transport controlling unit 101*d* selects the transport pulse control information corresponding to a next transport speed range (range including current transport speed), and performs the same process as the above-described process in Act 164. For example, based on the transport pulse control information FC1 corresponding to transport speed range of No. 1, when the speed reaches 1.0 IPS that is the final speed in the transport speed range of No. 1, a process for changing the transport speed is performed based on the transport pulse control information FC2 corresponding to the transport speed range of No. 2.

By repeatedly performing processes Act 163 to Act 166, based on the transport pulse control information FC1 to FC5, the transport controlling unit 101*d* causes the transport speed of the sheet P to sequentially reach each intermediate speed (1.0, 2.0, 4.0, and 6.0 IPS), and then the target speed (7.0 IPS). When the target transport speed is reached (Act 165; YES), the process proceeds to Act 17 illustrated in FIG. 9.

Returning to FIG. 9, when it is determined that the transport speed is not changed in Act 15 (Act 15; NO), after a process of Act 16 is performed, the transport controlling unit 101*d* drives the stepping motor 107 based on a pulse signal frequency at a constant speed which corresponds to the current transport speed (7.0 IPS), and transporting corresponding to the N-th line is performed.

Then, the transport controlling unit 101*d* determines whether or not N is the last line (Act 18). If N is not the last line, the process of the transport controlling unit 101*d* returns to Act 12, increases N, and performs the same process as the above-described process (Act 18; NO). Meanwhile, if N is the last line, the transport controlling unit 101*d* terminates the transport speed control process (Act 18; YES).

As described above, the thermal printer 1 according to the embodiment obtains at least one or more intermediate speeds that are defined in advance between the target transport speed and the current transport speed, and causes the transport speed of the sheet P to sequentially reach the intermediate speed and the target transport speed based on the transport pulse control information for each defined transport speed range, from the current transport speed to the target transport speed, where each defined transport speed range includes the obtained intermediate speed(s). With this, it is possible to decrease the number of pieces of the control information for reaching the target transport speed.

The above-described embodiment shows an example, and various modifications and applications are possible.

For example, an example in which the transport speed controller according to the above-described embodiment is described for the thermal printer. However, the transport speed controller may be used with a dot impact type, an ink jet type, or an electrophotographic type printer. In addition, the transport speed controller may be configured for controlling a transporting mechanism, and as a controller independent of the transporting mechanism. The transport speed controller may be provided with the POS terminal or automated teller machine (ATM) terminal other than the printer.

In addition, in the above-described embodiment, an example in which the target transport speed is defined according to the print rate is described. However, the target transport speed may be set in accordance with the print rate and other criteria, or based on a criterion not including the print rate. As the other criteria, for example, there is the number of driving blocks in a case of driving the heat generating element 111*a* of the thermal head 111 on block unit basis.

In addition, in the above-described embodiment, an example in which the transport speed of the roll paper PR is controlled is described. However, the sheet P as a transport target may be a regular sheet or a folded continuous sheet.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer comprising:

a communication interface configured to receive print data from an external device;

a print head configured to print on a sheet, line by line according to the received print data;

a motor configured to drive a roller to transport the sheet, line by line according to the received print data; and a processor configured to:

determine, for a current print line, a target transport speed for transporting the sheet, determine one or more intermediate speeds defined in advance and between a current transport speed of transporting the sheet and the target transport speed, and control the motor to transport the sheet at each determined intermediate speed and the target transport speed, sequentially.

2. The printer according to claim 1, wherein the processor determines the target transport speed based on a print rate of the current print line.

3. The printer according to claim 2, further comprising:

a storage unit that stores a plurality of transport speeds each in association with a different print rate range, wherein the processor determines the target transport speed as the transport speed that is stored in association with the print rate range that corresponds to the determined print rate of the current print line.

4. The printer according to claim 3, wherein:

the storage unit further stores a plurality of transport control signal information each in association with a different transport speed range, and the processor determines the one or more intermediate speeds as one intermediate speed in each stored transport speed range between the current transport speed and the target transport speed, and controls the motor to transport the sheet at each determined intermediate speed and the target transport speed by applying a control signal based on the transport control signal information associated with the corresponding transport speed range.

5. The printer according to claim 4, wherein the control signal is a pulse signal having a frequency defined by the corresponding transport control signal information.

6. The printer according to claim 2, wherein the print head prints on the sheet using heat.

7. The printer according to claim 6, wherein the print head includes a plurality of heat generating elements arranged in a direction orthogonal to a sheet transport direction.

8. The printer according to claim 7, wherein the print rate is a ratio of the number of heat generating elements to be used to print the current line and the total number of heat generating elements.

9. The printer according to claim 6, wherein the sheet is roll paper.

10. The printer according to claim 1, further comprising:

a speed reduction mechanism configured to transfer rotation force of the motor to the roller.

11. A method of controlling a transport speed of a printer, the method comprising:

receiving print data from an external device;

determining, for a current print line to be printed on a sheet by a print head, a target transport speed for transporting the sheet;

determining one or more intermediate speeds defined in advance and between a current transport speed of transporting the sheet and the target transport speed; and controlling a motor to transport the sheet at each determined intermediate speed and the target transport speed, sequentially.

12. The method according to claim 11, wherein the target transport speed is determined based on a print rate of the current print line.

13. The method according to claim 12, further comprising:

storing a plurality of transport speeds each in association with a different print rate range, wherein the target transport speed is determined as the transport speed that is stored in association with the print rate range that corresponds to the determined print rate of the current print line.

14. The method according to claim 13, further comprising:

storing a plurality of transport control signal information each in association with a different transport speed range, wherein:

the one or more intermediate speeds are determined as one intermediate speed in each stored transport speed range between the current transport speed and the target transport speed, and the motor is controlled to transport the sheet at each determined intermediate speed and the target transport speed by applying a control signal based on the transport control signal information associated with the corresponding transport speed range.

15. The method according to claim 14, wherein the control signal is a pulse signal having a frequency defined by the corresponding transport control signal information.

16. The method according to claim 12, wherein the print head prints on the sheet using heat.

17. The method according to claim 16, wherein the print head includes a plurality of heat generating elements arranged in a direction orthogonal to a sheet transport direction.

18. The method according to claim 17, wherein the print rate is a ratio of the number of heat generating elements to be used to print the current line and the total number of heat generating elements.

19. The method according to claim 16, wherein the sheet is roll paper.

20. The method according to claim 11, wherein a speed reduction mechanism transfers rotation force of the motor to a roller that conveys the sheet.

* * * * *